US010851783B2

(12) United States Patent
Birch et al.

(10) Patent No.: US 10,851,783 B2
(45) Date of Patent: Dec. 1, 2020

(54) DRY VACUUM PUMP WITH PRESSURIZED BEARING AND SEAL

(71) Applicant: Leybold GmbH, Cologne (DE)

(72) Inventors: Peter Birch, Sussex (GB); Robert Jenkins, Sleaford (GB); Clive Tunna, Sussex (GB)

(73) Assignee: LEYBOLD GMBH, Cologne (DE)

( * ) Notice: Subject to any disclaimer, the term of this patent is extended or adjusted under 35 U.S.C. 154(b) by 293 days.

(21) Appl. No.: 15/771,776

(22) PCT Filed: Oct. 31, 2016

(86) PCT No.: PCT/EP2016/076223

§ 371 (c)(1),
(2) Date: Apr. 27, 2018

(87) PCT Pub. No.: WO2017/076803

PCT Pub. Date: May 11, 2017

(65) Prior Publication Data

US 2018/0340535 A1 Nov. 29, 2018

(30) Foreign Application Priority Data

Nov. 3, 2015 (DE) ..... 20 2015 007 606 U

(51) Int. Cl.
*F04C 27/00* (2006.01)
*F04C 25/02* (2006.01)

(52) U.S. Cl.
CPC ..... *F04C 27/009* (2013.01); *F04C 25/02* (2013.01); *F04C 2220/12* (2013.01); *F04C 2240/50* (2013.01)

(58) Field of Classification Search
CPC ..... F04C 2240/50; F04C 27/009; F04C 15/0038; F04C 25/02
See application file for complete search history.

(56) References Cited

U.S. PATENT DOCUMENTS 6,969,242 B2 * 11/2005 Yannascoli ..... F04C 27/009 277/412
2001/0048885 A1 * 12/2001 Gennami ..... F04C 27/009 418/55.4

(Continued)

FOREIGN PATENT DOCUMENTS

DE 202012000611 U1 4/2013
EP 1270948 A2 1/2003

(Continued)

OTHER PUBLICATIONS

International Search Report dated Feb. 3, 2017 for PCT application No. PCT/EP2016/076223.

*Primary Examiner* — Mary Davis
(74) *Attorney, Agent, or Firm* — Ohlandt, Greeley, Ruggiero and Perle, LLP

(57) ABSTRACT

A dry vacuum pump, comprising a pump housing, which forms a plurality of suction chambers, wherein rotor elements are arranged in the suction chambers, in order to convey a pump medium from a high-vacuum-side inlet to an outlet. At least one rotor element is arranged in each suction chamber. The rotor elements are connected to a rotor shaft. The rotor shaft is supported by bearings, wherein a high-vacuum-side bearing is arranged in a cut-out. A sealing device is arranged between the high-vacuum-side bearing and at least one suction chamber adjacent to the high-vacuum-side bearing. The cut-out is connected, by means of a first channel, to a region of the dry vacuum pump in which there is a higher pressure than in at least one suction chamber adjacent to the high-vacuum-side bearing.

19 Claims, 3 Drawing Sheets

(56) References Cited

U.S. PATENT DOCUMENTS

| | | | |
|---|---|---|---|
| 2012/0003105 | A1 | 1/2012 | Crochet |
| 2014/0369809 | A1 | 12/2014 | Beyer et al. |

FOREIGN PATENT DOCUMENTS

| | | | |
|---|---|---|---|
| EP | 1975411 | A1 | 10/2008 |
| EP | 2402613 | A1 | 1/2012 |
| EP | 2431613 | A2 | 3/2012 |
| JP | 2002213464 | A | 7/2002 |

* cited by examiner

DRY VACUUM PUMP WITH PRESSURIZED BEARING AND SEAL

BACKGROUND

1. Field of the Disclosure

The disclosure relates to a dry vacuum pump for generating a vacuum.

2. Discussion of the Background Art

Known dry vacuum pumps comprise a rotor element connected to a rotor shaft supported for rotation and driven by an electric motor. The rotor element is arranged in a suction chamber formed by a pump housing. The pump housing has an inlet and an outlet, with a pump medium being conveyed from the inlet to the outlet by rotation of the rotor element. For this purpose, the dry vacuum pump in particular comprises a plurality, preferably two rotor elements in one suction camber which cooperate to convey the pump medium.

For generating a high vacuum, dry vacuum pumps are designed as multi-stage pumps so that a plurality of suction chambers is formed in a pump housing, in each of which at least one rotor element is arranged. The individual suction chambers are fluidically connected by suited connection channels so that the pump medium is conveyed from the inlet through each suction chamber. In particular, pressures of less than 1 mbar up to less than 0.0001 mbar are generated thereby.

It is a particularity of known dry vacuum pumps that the seal between the rotor element and the pump housing is oil-free. This offers the particular advantage that no oil-containing air can escape from the dry vacuum pump to contaminate connected apparatuses.

The rotor shaft is supported by bearings with respect to the pump housing, the bearings being in particular roller bearings. Due to the high speed of rotation of the rotor shaft, these bearings must be lubricated. The lubricants used for lubrication must be adapted to the vacuum prevailing at the bearing so as to prevent the lubricant from being gassed out. This limits the choice of possible lubricants for the bearings. Since the lubrication and the bearings in dry vacuum pumps have to be matched to each other, there also is a restriction to the bearings that can be used, which usually leads to higher costs, since special bearings are required.

It is an object of the present disclosure to provide a dry vacuum pump in which more economic bearings may be used.

SUMMARY

The dry vacuum pump of the present disclosure comprises a pump housing. The pump housing forms a plurality of suction chambers. Rotor elements are arranged in the suction chambers for conveying a pump medium from a high vacuum-side inlet to an outlet. At least one rotor element is arranged in each suction chamber. Preferably, two rotor elements are arranged in at least one suction chamber, which cooperate in a suitable manner for conveying the pump medium from the inlet to the outlet.

According to the disclosure, the rotor elements are connected to a rotor shaft. If more than one rotor element is provided per suction chamber, individual rotor elements are connected with a respective rotor shaft. Here, at least one rotor shaft is driven, preferably by an electric motor.

According to the disclosure the rotor shaft is supported by bearings, wherein a high vacuum-side bearing is arranged in a recess. Here, the high vacuum-side bearing is the bearing which is closer to the high vacuum, seen in the longitudinal direction. Here, the high vacuum-side bearing is not necessarily arranged on the high vacuum-side end of the rotor shaft. However, this is possible and is covered by the definition of the high vacuum-side bearing. On the other hand, there is an outlet-side bearing which, seen in the direction of the high vacuum, is arranged before the high vacuum-side bearing in the longitudinal direction of the rotor shaft.

The recess according to the present disclosure is preferably formed by the housing and is open in particular towards the rotor shaft. Since, according to the disclosure, the high vacuum-side bearing is arranged in the recess, the recess is formed at the site of the high vacuum-side bearing. According to the disclosure a sealing device is arranged between the high vacuum-side bearing and at least one suction chamber which is in particular immediately adjacent the high vacuum-side bearing. Further, a first duct connects the recess, in which the high vacuum-side bearing is arranged, with a region of the dry vacuum pump in which a higher pressure prevails than in the at least one suction chamber adjacent the high vacuum-side bearing. The first duct ensures that a higher pressure prevails in the recess than in the at least one suction chamber adjacent the high vacuum-side bearing. Thus, the high vacuum-side bearing is subjected to a pressure that is lower than in the at least one suction chamber adjacent the high vacuum-side bearing. Thus, it is possible to use other lubricants and to therefor also use more economic bearings, since these have to meet less strict requirements with respect to compatibility with high vacuum. Specifically, the problem of the lubricant being gassed out is reduced. It is ensured by providing the first duct that a defined pressure prevails in the recess, which is determined by the region of the dry vacuum pump to which the first duct is connected.

Preferably, the dry vacuum pump is a claw pump, a Roots pump or a screw-type pump.

Preferably, the dry vacuum pump generates a pressure of less than 1 mbar, preferably less than 0.001 mbar and particularly preferred less than 0.0001 mbar.

Preferably, the high vacuum-side bearing is a grease-lubricated bearing. This is possible, because a higher pressure prevails in the recess than in the at least one suction chamber adjacent the high vacuum-side bearing. Grease for lubrication of a bearing in particular has the tendency to gas out in a vacuum and to thereby lose its lubricating properties. Only by providing the first duct, by which the pressure in the recess and thus also at the high vacuum-side bearing can be increased, is it possible at all to use a grease-lubricated bearing as a high vacuum-side bearing. Grease-lubricated bearings are, among others, standard bearings so that the costs for the bearings used can be reduced further.

Preferably, oil is present neither in the recess, nor in the sealing device. It is particularly preferred that the sealing device is a dry seal. Oil has the significant disadvantage that, due to its low viscosity, it can reach the suction chamber via the sealing device, so that devices connected to the dry vacuum pump may be contaminated by oil-containing air. If no oil is present, be it in the recess or in the sealing device, this problem is avoided in a simple manner. Further, no grease or another sealant is contained in the sealing device.

The sealing device is preferably formed as a dry sealing so that a sealing material may be used that does not have to be additionally wetted with oil. In particular, the sealing is a contactless shaft sealing with a very small sealing gap.

Preferably, the sealing device comprises at least one lip seal, the at least one lip seal in particular being a PTFE lip seal. Lip seals are a standard product which can be manufactures in a simple manner and can be obtained in an economic manner. Due to the controllable pressure difference between the recess and the suction chamber adjacent the high vacuum-side bearing, it is ensured the first duct that on the one hand a contact exists between the lip seal and the shaft, and on the other hand the lip seal is not burnt or worn too fast due to the fast rotation of the rotor shaft. The contact pressure is controllably by means of the controllable pressure difference.

Preferably, the sealing device comprises at least two lip seals, wherein an intermediate chamber between the at least two lip seals is connected to a region of the dry vacuum pump via a second duct, in which region a second pressure prevails which is higher than the pressure in the at least one suction chamber adjacent the high vacuum-side bearing, yet at the same time lower than the pressure in the recess. Thus, seen in relation, the lowest pressure prevails in the at least one suction chamber adjacent the high vacuum-side bearing and the highest pressure prevails in the recess, wherein this pressure difference is adjusted preferably in a step-like manner via the intermediate chamber. Thus, it is ensured on the one hand that only a certain pressure difference prevails per lip seal so that the lip seal is prevented from burning or being worn too fast. At the same time, by providing at least two lip seals, it is possible to achieve a greater pressure difference between the recess and the suction chamber adjacent the high vacuum-side bearing. Thus, a higher pressure can prevail in the region of the recess, whereby the requirements to the bearings and the lubricant of the bearings with respect to the compatibility with high vacuum. Of course, more than two lip seals may be provided, wherein it is particularly preferred to provide an intermediate chamber between two respective lip seals. None, one, a plurality or all of the intermediate chambers may be connected to suitable regions of the dry vacuum pump via ducts, so that the pressures in the intermediate chambers can be chosen exactly, so that the properties of the lip seals can be taken into consideration.

Preferably, a pressure of 1000 mbar to 0.1 mbar prevails in the at least one suction chamber adjacent the high vacuum-side bearing.

Preferably, a pressure prevails in the recess that is less than the ambient pressure or atmospheric pressure of the dry vacuum pump. In particular, when using grease-lubricated bearings it is not required that ambient pressure prevails at the bearing. Thereby, the pressure difference between the recess and the suction chamber adjacent the high vacuum-side bearing can be kept as small as possible, whereby in particular the sealing device can have a simple structure.

Preferably, a pressure of more than 100 mbar, more preferred more than 400 mbar and particularly preferred more than 500 mbar prevail in the recess.

Preferably, a pressure difference of <300 mbar, more preferred <200 mbar and particularly preferred <50 mbar exists between the at least one suction chamber adjacent the high vacuum-side bearing and the recess.

The first duct preferably has two points of connection by which the first duct is connected to the recess, wherein a respective point of connection is arranged on a respective side of the high vacuum-side bearing so that no pressure difference exists between the sides of the high vacuum-side bearing. Typically, bearings are not designed for compensating a pressure difference. By providing two points of connection of the first duct it is ensured that no pressure difference exists across the high vacuum-side bearing.

The dry vacuum pump preferably is a multi-stage pump. Here, in particular two suction chambers are connected through a connecting duct for fluidic communication of the suction chambers. Thus, the pump medium can flow from one suction chamber into the adjoining suction chamber via the connecting duct. Here, preferably the first duct pump and/or the second duct are connected to a respective connecting duct.

Preferably, the high vacuum-side bearing is arranged in the end portion of the rotor shaft. In particular, no further element is connected to the shaft outside the high vacuum-side bearing, with the exception of a sealing element, if so provided. Specifically, the end portion is the portion covering the outer 5 cm, in particular the outer 3 cm of the shaft.

Preferably, the at least one suction chamber adjacent the high vacuum-side bearing is connected to the inlet.

The dry vacuum pump preferably comprises at least one first suction chamber, an intermediate suction chamber and a last suction chamber, wherein the first suction chamber is arranged in particular immediately adjacent the high vacuum-side bearing. Further, the inlet is connected to the intermediate suction chamber and the outlet is connected to the last suction chamber. The pump medium is conveyed from the intermediate suction chamber to the first suction chamber, whereafter the pump medium is conveyed from the first suction chamber to the last suction chamber. By this arrangement, the intermediate suction chamber connected to the inlet has the lowest pressure. However, the first suction chamber is immediately adjacent to the high vacuum-side bearing, in which first suction chamber already a higher pressure prevails than in the intermediate suction chamber. Thus, the pressure difference between the suction chamber adjacent the high vacuum-side bearing and the recess in which the high vacuum-side bearing is arranged is reduced. If the inlet were connected directly to the first suction chamber, the first suction chamber would have the lowest pressure so that a greater pressure difference would have to be bridged by the sealing device.

Preferably, two suction chambers are separated by a partitioning wall, wherein the connecting duct is arranged in the partitioning wall. Preferably, the first and/or the second duct are directly connected to a respective suction chamber.

The pump housing preferably has a separation plane extending in the longitudinal direction of the rotor shaft. It is particularly preferred that the pump housing is of a two-part design. The structure of the pump housing is simplified in this manner. Particularly preferred, it is thus possible to use a unitary rotor shaft.

Preferably, the parts of the pump housing have contact surfaces through which the separating plane extends. Here, the first duct and/or the second duct are formed as a groove in one of the contact surfaces. This allows the course of the first and/or second duct to be formed in a simple manner. By assembling the parts of the pump housing, the groove is sealed by the contact surface of the part assembled thereto so that a closed duct is formed.

The disclosure will be explained in more detail hereunder with reference to preferred embodiments and to the Figures.

DETAILED DESCRIPTION OF THE PREFERRED EMBODIMENT

Figure 1:
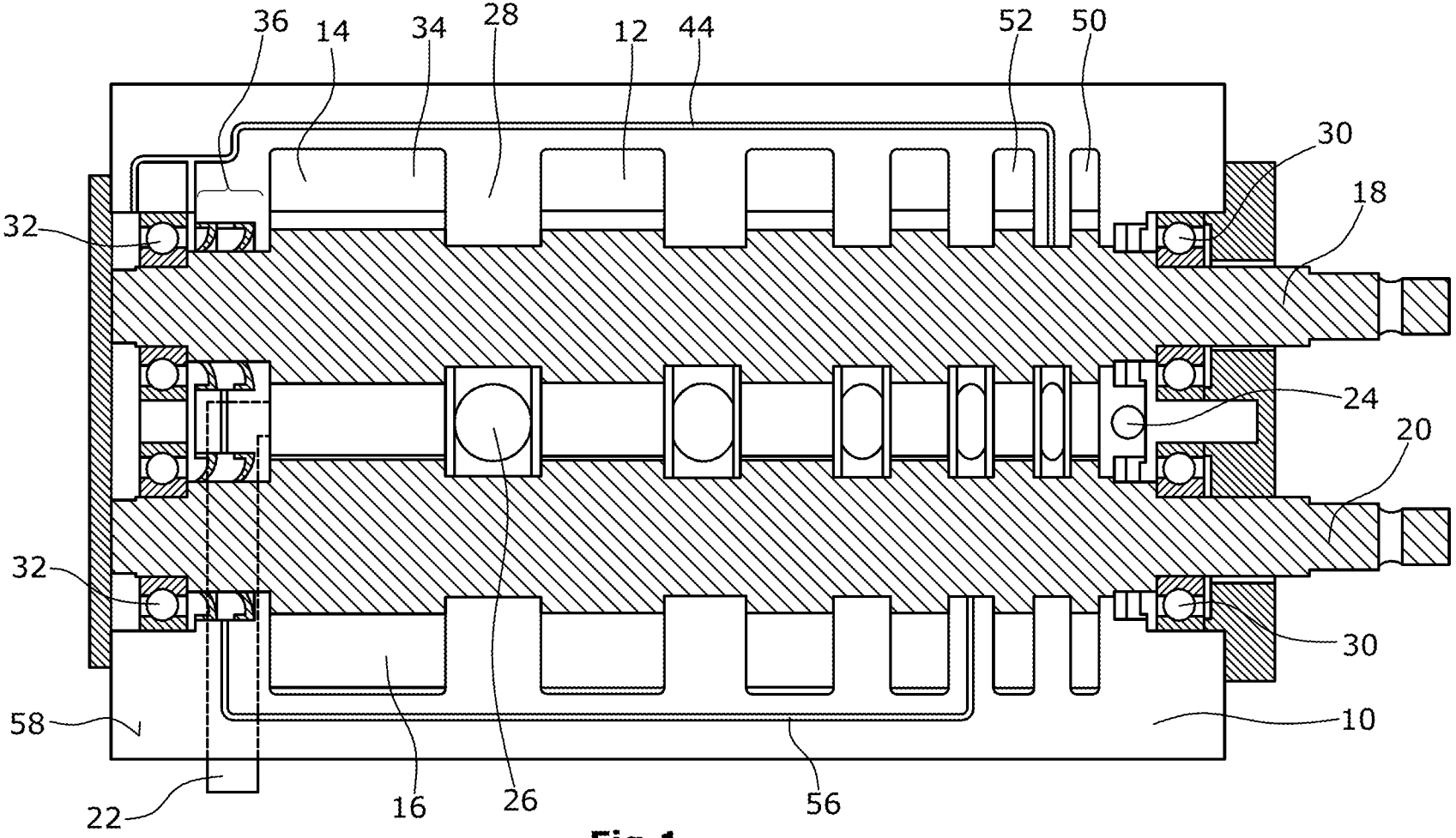
FIG. 1 is a schematic illustration of a dry vacuum pump according to the disclosure, cut along a separating plane of the pump housing.

The dry vacuum pump of the present disclosure comprises a plurality of pump stage arranged in axial succession. A plurality of suction chambers 12 is provided in one pump housing 10. First rotor elements 14 and second rotor elements 16 are arranged in the suction chambers 12. The first rotor elements 14 are connected to a first rotor shaft 18, and the second rotor elements 16 are connected to a second rotor shaft 20. First rotor elements 14 and second rotor elements 16 cooperate in such a manner that a pump medium is conveyed from the inlet 22 to the outlet 24. For this purpose, the individual pump stages are connected via connecting ducts 26 arranged in the partitioning walls 28 that separate the suction chambers 12 from each other.

The rotor shafts 18 and 20 are rotatably supported by vacuum-side bearings 30, as well as by high vacuum-side bearings 32. In the embodiment illustrated, the high vacuum-side bearing 32 is arranged in the end region of the respective shaft 18, 20.

Figure 2:
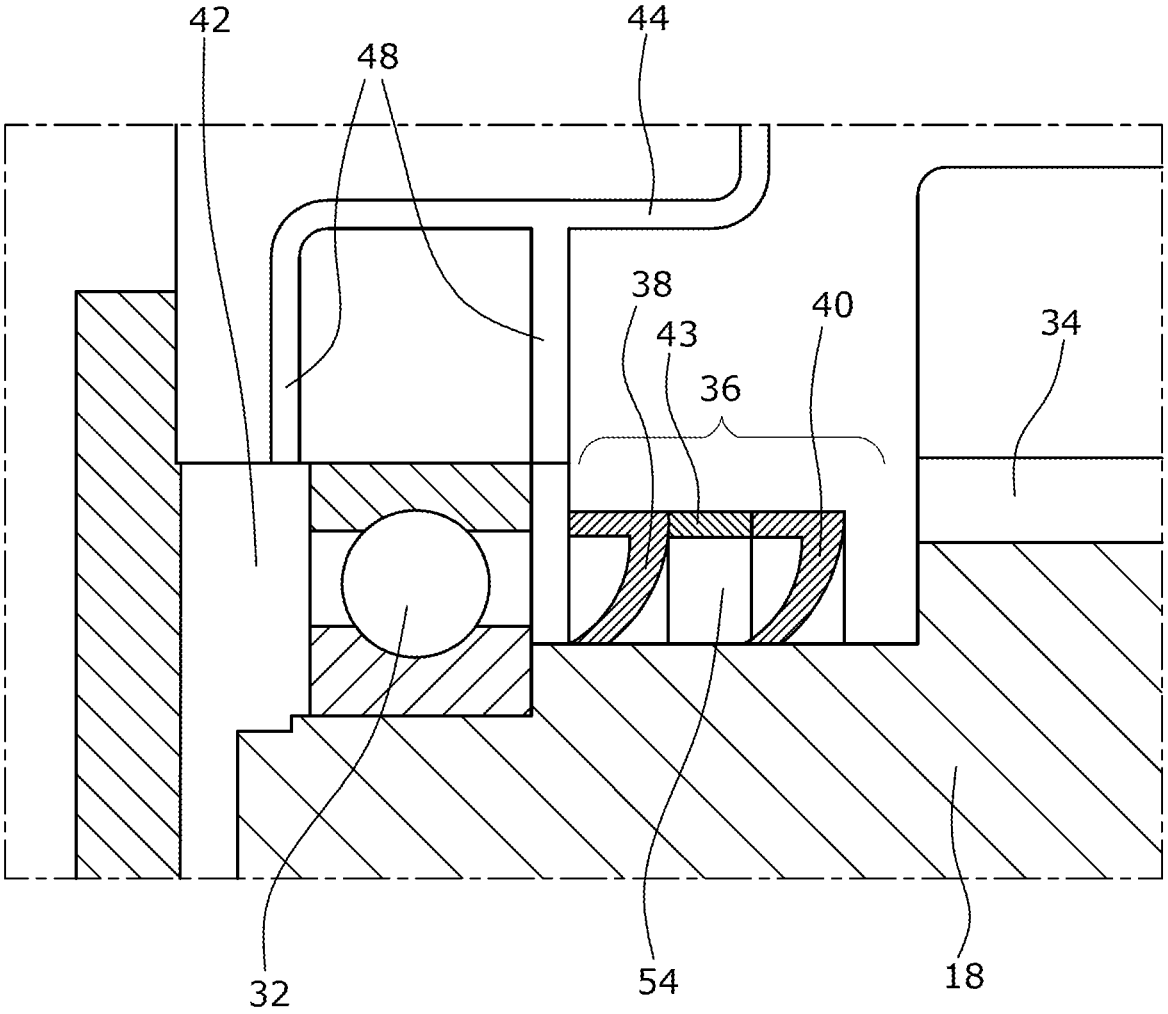
FIG. 2 is a detail of the high vacuum-side bearing and the sealing device of the dry vacuum pump shown in FIG. 1, and FIG. 3 an alternative embodiment.

A first suction chamber 34 is immediately adjacent to the high vacuum-side bearing 32. The inlet is connected to the first suction chamber 34 so that a low pressure prevails in the first suction chamber 34. A sealing device 36 is arranged between the high vacuum-side bearing 32 and the first suction chamber 34, which sealing device is illustrated in detail in FIG. 2. The sealing device 36 comprises a first lip seal 38, as well as a second lip seal 40. These are separated from each other by a spacer 43. Both the first lip seal 38 and the second lip seal 40 are in contact with the rotor shaft 18.

The high vacuum-side bearing 32 is arranged in a recess 42. A first duct 44 is connected to the recess 42. The first duct 44 has two points of connection 48 connected to the recess 42 on one side of the high vacuum-side bearing 32, respectively. It is thereby ensured that no pressure difference prevails across the high vacuum-side bearing, which would have to be compensated by the bearing. This would lead to increased wear or a compromised performance of the bearing. The first duct 44 is connected to a connecting duct 26. In the embodiment illustrated in FIG. 1, the first duct 44 is connected to the connecting duct between the last suction chamber 50 and the penultimate suction chamber 52. At this site, a relatively high pressure of preferably up to 500 mbar already prevails. However, due to the last pump stage arranged in the last suction chamber 50, this pressure is always lower than the ambient pressure around the vacuum pump. It is ensured via the first duct 44 that the same pressure prevails in the recess 42 as in the connecting duct between the last suction chamber 50 and the penultimate suction chamber 52. If the pressure in this region is e.g. 500 mbar, the high vacuum-side bearing is also arranged in a pressure of 500 mbar. Thus, it is possible to use a variety of further lubricants for the high vacuum-side bearing 32. Specifically, the high vacuum-side bearing 32 can therefore be a grease-lubricated bearing.

In the embodiment illustrated, a pressure difference of about 500 mbar exists between the first suction chamber 34 and the recess 42. Usually, this great pressure difference cannot be sealed in a sufficient manner by a dry seal, in particular because of the high rotational speed of the rotor shaft 18. For this reason, the sealing device 36 comprises the first lip seal 38 and the second lip seal 40, between which an intermediate chamber 54 is formed. Here, the intermediate chamber 54 is connected to a region of the vacuum pump via a second duct 56, in which region a higher pressure prevails than in the first suction chamber 34, yet a lower pressure than in the recess 42 in which the high vacuum-side bearing 32 is arranged. For this purpose, it is possible e.g. to connect the second duct 56 to a connecting duct 26 situated, seen in the flow direction, upstream of the connecting duct 26 which the first duct 44 is connected to. By providing the second duct 56, it can be ensured that only a pressure difference is applied across a single lip seal 38, 40 for which the lip seal is actually designed. Thus, strong wear or a burning of the lip seal 38, 40 is prevented.

FIG. 1 shows the dry vacuum pump in section, where the sectional plane coincides with the separation plane of the pump housing 10. The Figure shows the lower pump housing half which has a contact surface 58 by which the lower half of the pump housing 10 is joined to an upper half of the pump housing 10. Here, the first duct 44 and the second duct 56 are formed as grooves in the contact surface 58. By assembling the first pump housing part to the second pump housing part, the groove formed is closed so that the first duct 44 and the second duct 56 are formed.

Of course, further lip seals may be provided in the sealing device 36. The intermediate chambers formed thereby may be connected to further ducts so that a step-wise equalization of the pressure between the first suction chamber 34 and the recess 42 is effected.

Figure 3:
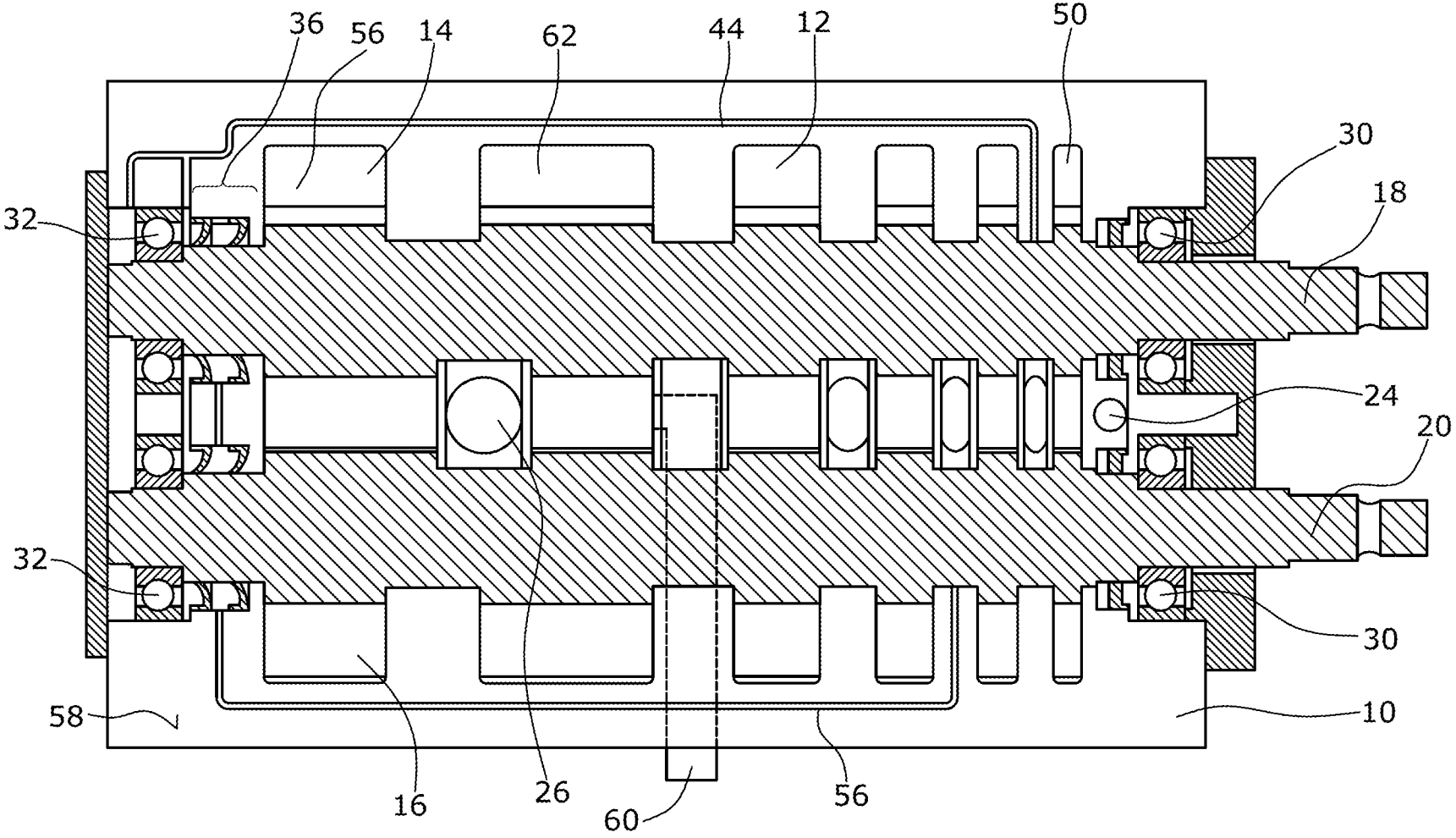

Another embodiment is illustrated in FIG. 3, in which like elements are identified by like reference numerals.

In the dry vacuum pump illustrated in FIG. 3, an inlet 60 is connected to an intermediate suction chamber 62. Thus, the lowest pressure prevails in the intermediate suction chamber 62. From the intermediate pump chamber 62, the pump medium s conveyed by the rotor elements 14 into a first suction chamber 34 via connecting ducts 26. Here, a higher pressure already prevails in the first suction duct 34 than in the intermediate suction chamber 62. The pressure difference between the recess 42 in which the high vacuum-side bearing 32 is arranged and the first suction chamber 34 is thus reduced so that the structure of the sealing device 36 can be simplified. Via a connecting duct (not illustrated), the pump medium flows from the first suction chamber, via further suction chambers possibly provided, into a last suction chamber 50 and from there to the outlet 24.

Owing to the arrangement of the pump stages, it is possible to reduce the requirements to the sealing device 36 in a simple manner, so that a higher pressure is achieved in the recess 42. It is thus possible to use a grease-lubricated bearing as the high vacuum-side bearing 32.

In neither of the two embodiments it is required to actively cool the lip seals. Nor is it required to provide oil in the region of the sealing device 36 so as to achieve a suitable sealing effect of the lip seals 38, 40.

If the dry vacuum pump is a double-shaft pump. Sealing devices 36 are provided in particular at both high vacuum-side bearings 32. Preferably, the sealing devices 36 are of identical design in this case.

What is claimed is:

1. A dry vacuum pump, comprising:

a pump housing defining a plurality of suction chambers, rotor elements arranged in the plurality of suction chambers for conveying a pump medium from a high vacuum-side inlet to an outlet, wherein at least one rotor element of the rotor elements is arranged in each of the plurality of suction chambers, a rotor shaft connected with the rotor elements, and bearings supporting the rotor shaft, wherein the bearings comprise a high vacuum-side bearing arranged in a recess, wherein a seal is arranged between the high vacuum-side bearing and one suction chamber of the plurality of suction chambers is adjacent the high vacuum-side bearing, and wherein a first duct connects the recess with a region of the dry vacuum pump in which a higher pressure prevails than in the one suction chamber adjacent the high vacuum-side bearing.

2. The dry vacuum pump of claim 1, wherein the high vacuum-side bearing is a grease-lubricated bearing.

3. The dry vacuum pump of claim 1, wherein oil is present neither in the recess, nor in the seal.

4. The dry vacuum pump of claim 1, wherein the seal comprises at least one lip seal.

5. The dry vacuum pump of claim 4, wherein the at least one lip seal is a PTFE lip seal.

6. The dry vacuum pump of claim 1, wherein the seal comprises at least two lip seals, and an intermediate chamber between the at least two lip seals is connected, via a second duct, with a second region of the dry vacuum pump in which a pressure prevails that is higher than the pressure in the one suction chamber adjacent the high vacuum-side bearing and lower than the pressure in the recess.

7. The dry vacuum pump of claim 6, wherein two suction chambers are connected by a connecting duct for a fluid communication of the plurality of suction chambers, and that the first duct and/or the second duct are respectively connected with one connecting duct.

8. The dry vacuum pump of claim 6, wherein the first and/or the second duct are directly connected with a respective suction chamber.

9. The dry vacuum pump of claim 1, wherein, in the one suction chamber adjacent the high vacuum-side bearing, a pressure less than 0.01 mbar prevails.

10. The dry vacuum pump of claim 1, wherein a pressure prevailing in the recess is lower than an ambient pressure of other regions of the dry vacuum pump.

11. The dry vacuum pump of claim 1, wherein a pressure prevailing in the recess is higher than 100 mbar.

12. The dry vacuum pump of claim 11, wherein two of the plurality of suction chambers are separated by a partition wall and the connecting duct is arranged in the partition wall.

13. The dry vacuum pump of claim 11, wherein the pressure prevailing in the recess is higher than 400 mbar.

14. The dry vacuum pump of claim 1, wherein a pressure difference between the one suction chamber adjacent the high vacuum-side bearing and the recess is less than 300 mbar.

15. The dry vacuum pump of claim 14, wherein the pressure difference between the one suction chamber adjacent the high vacuum-side bearing and the recess is less than 200 mbar.

16. The dry vacuum pump of claim 1, wherein the first duct has two points of connection with the recess, wherein a respective one of the points of connection is arranged on a respective side of the high vacuum-side bearing, so that no pressure difference exists between the sides of the high vacuum-side bearing.

17. The dry vacuum pump of claim 1, wherein the high vacuum-side bearing is arranged in an end region of the rotor shaft.

18. The dry vacuum pump of claim 1, wherein the plurality of suction chambers comprise a first suction chamber, an intermediate suction chamber, and a last suction chamber, wherein the first suction chamber is the one suction chamber arranged immediately adjacent the high vacuum-side bearing, wherein the high vacuum-side inlet is connected with the intermediate suction chamber, wherein the outlet is connected with the last suction chamber, and wherein the pump medium is conveyed from the intermediate suction chamber to the first suction chamber and the pump medium is conveyed from the first suction chamber to the last suction chamber.

19. The dry vacuum pump of claim 1, further comprising a separation plane of the pump housing extends in the longitudinal direction of the rotor shaft.

* * * * *